US005441007A

United States Patent [19]

Hunt

[11] Patent Number: 5,441,007

[45] Date of Patent: Aug. 15, 1995

[54] BOAT DOCKING APPARATUS AND METHOD

[76] Inventor: Milby N. Hunt, 19 Manor Way, Galveston, Tex. 77550

[21] Appl. No.: 342,733

[22] Filed: Nov. 21, 1994

[51] Int. Cl.[6] ..... B63B 21/00

[52] U.S. Cl. ..... 114/230; 114/263

[58] Field of Search ..... 114/230, 263

[56] References Cited

U.S. PATENT DOCUMENTS 3,237,587 3/1966 Ross ..... 114/230

3,763,816 10/1973 Wilson, Jr. ..... 114/230

*Primary Examiner*—Jesus D. Sotelo

*Attorney, Agent, or Firm*—Browning, Bushman, Anderson & Brookhart

[57] ABSTRACT

Apparatus and method are disclosed herein for docking a boat. The present invention may be used to dock motor powered or sail boats weighing upwards of several tons that when moving have a large, potentially damaging inertia due to their weight. A guide frame configuration provides a large target to which the boat can be steered, and once therein the guide frame directs the boat centrally inwardly with respect to the guide frame. The guide frame moves axially with the momentum of the boat supported by an elongate support member. One or more compression members are compressed by a stop member upon reaching the desired docking target. The compression members are compressible between push pipes that move with the guide frame on an elongate support member and a stop member that is fixed with respect to the elongate support member.

20 Claims, 3 Drawing Sheets

BOAT DOCKING APPARATUS AND METHOD

BACKGROUND OF THE INVENTION

1. Field of the Invention

The present invention generally relates to an improved boat docking apparatus and method. More particularly, the present invention is directed to a boat docking apparatus including a slidable guide frame supported by an elongate member and including thereon a substantially co-axial compression member for compressably de-accelerating the boat into a desired docking position.

2. Description of the Background

A typical yacht weighs at least several tons and, even at relatively low speeds, the yacht has a significant inertia that can produce a damaging impact if docking is not precisely accomplished. As the size or speed of the yacht increases, the inertia and also the potential for damage increases. Damage can occur to the boat dock or to the yacht at the point of impact. In each case, such damage is expensive and time consuming to repair. Those skilled in the art are well aware that as the weight of the yacht increases, the importance of a reliable, safe docking procedure increases. As well, the docking maneuver is made each time the boat is to be off-loaded or on-loaded and is perhaps the most frequently made maneuver.

Even if damage does not occur during the docking maneuver due to impact with the dock, the boat may inconveniently drift away from the dock after the power is removed or sails lowered and before the Captain has time to attach a mooring line or lines. Such problems are exacerbated if the Captain of the boat is alone on the boat and must perform the docking and mooring procedures by himself in a high wind.

Various methods have been used in the past to prevent damage caused by the docking maneuver. For instance, padding may be added to the dock, pier, and/or boat. However, such padding must necessarily be extensive to cover most portions of the pier or boat which may be damaged. Furthermore, the padding may be inadequate to absorb enough of the inertia of the yacht to prevent damage. Padding is not always available to protect those pans of a boat which are typically below the water line.

Substantial time may be spent in installing such padding. The padding may be expensive or, if inexpensive, may be aesthetically displeasing to the eye. Over time, such padding may develop barnacles that can scrape or otherwise damage the boat. The extensive padding will then require removal with the attendant costs of considerable labor. Depending on the weight of the boat and direction of impact, such padding may not be sufficiently shock absorbent. The padding is of no help in preventing drifting of the boat that may hamper mooring.

Thus, a need exists for improved methods and apparatus for docking boats, especially boats weighing upwards of several tons, to prevent damage to such boats and aid in mooring the boats. Those skilled in the an have long sought and will appreciate the novel features of the present invention that conveniently solves these and other problems.

SUMMARY OF THE INVENTION

The present invention is directed to an improved method and apparatus for docking boats typically weighing upwards of several tons.

The docking apparatus comprises a guide frame for receiving the boat with the guide frame being open at one end and having an open mouth wedge-shaped portion operable for receiving and directing the boat towards an apex region of the guide frame. At least one elongate slide member is adjacent the guide frame for supporting the guide frame. The guide frame is movable in a direction substantially parallel to the at least one elongate slide member. First and second sliding connectors are provided for slidingly securing the guide frame with respect to the at least one elongate slide member. The first and second sliding connectors are movable along the at least one elongate slide member. A push pipe is slidingly carried by the at least one elongate slide member between the first and second sliding connectors. The push pipe is movable along the at least one elongate slide member with the first and second sliding connectors. A compression member is disposed on the at least one elongate slide member. A stop member is provided to be substantially immovable with respect to the at least one elongate slide member. The stop member is operable to compress the compression member against the momentum of the boat as the guide frame moves in a direction substantially parallel to the first elongate slide member for compressibly stopping movement of the boat.

In operation, the method for docking the boat provides a wedge-shaped open mouth portion for directing the boat toward a desired target region. The boat is steered into the wedge-shaped open mouth portion. The wedge-shaped open mouth portion is moved in a target direction toward the desired docking target region via the momentum of the boat. The wedge-shaped open mouth portion is slidingly supported with an elongate member. The elongate member is substantially parallel to the target direction. An elongate compression member is disposed substantially in axial alignment with the elongate member. The elongate compression member compresses with the momentum of the boat to thereby de-accelerate the boat.

The movement of the boat is constrained inwardly within the wedge-shaped open mouth portion towards a center region of the wedge shaped open mouth portion.

An object of the present invention is to provide an apparatus for docking a boat which effectively navigates the boat during the docking maneuver.

Another object of the present invention is to provide an apparatus which controls movement of the boat so the Captain of the boat can dock and moor the boat without assistance.

A feature of the present invention is a central guide frame for receiving the boat and guiding the boat towards the dock in a desired path.

Another feature of the present invention is a guide frame that is easily altered to adapt to receiving either the bow or the aft end of the boat.

An advantage of the present invention is provision a flexible design that allows use on either a floating dock or fixed dock.

An additional advantage of the present invention is provision for accommodating various size boats.

These and further objects, features, and advantages of the present invention will become apparent from the following detailed description, wherein reference is made to the figures in the accompanying drawings.

While the invention will be described in connection with the presently preferred embodiments, it will be understood that it is not intended to limit the invention to these embodiments. On the contrary, it is intended to cover all alternatives, modifications, and equivalents as may be included in the spirit of the invention or as defined in the appended claims, specification or figures.

DETAILED DESCRIPTION OF THE PREFERRED EMBODIMENTS

The present invention relates to a novel boat docking method and apparatus that reliably and safely controls the path through the water taken by a boat entering a boat slip to prevent damage to the boat or to the dock. The system preferably uses elongate slide members such as guide lines, both to port and to starboard in the slip which are normally attached to pilings or other fixed elements in order to form a base position for the guidelines. The system includes a bow and aft position central connector for receiving the bow or aft of a boat during docking. The central connector is part of a guide frame constrained by elongate slide members, such as guide lines, to move the boat along the preferred docking path before bringing the boat to a gentle and safe stop.

Figure 1:
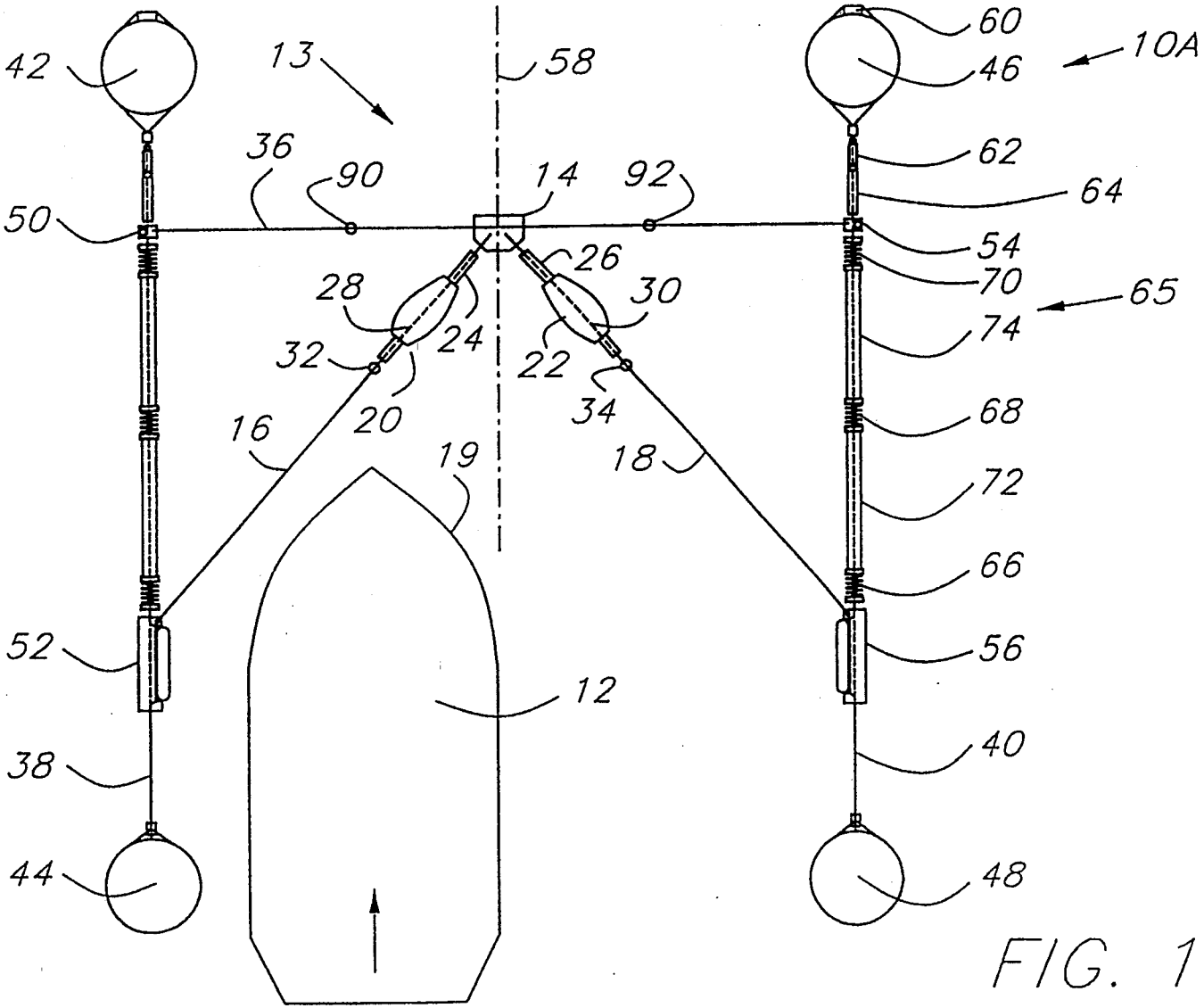
FIG. 1 is an diagrammatic view of a boat docking system in accord with the present invention.

The main features of the present invention may be seen in FIG. 1 which shows boat 12 approaching boat docking apparatus 10A in accord with the method and apparatus of the present invention. Guide frame 13 includes central connector 14 supported at the apex of guide lines 16 and 18 that form a V-shaped, or wedge shaped open mouth portion of guide frame 13 to receive and guide boat 12 appropriately even if boat 12 is not on course for a good landing.

Guide lines 16 and 18 preferably support fenders 20 and 22, respectively, that softly and protectively engage the bow 19 of boat 12. Fenders 20 and 22 are spaced appropriately for the desired contact with bow 19 using space or push pipes 24 and 26, such as PVC pipes, that are cut appropriately to the desired length as spacer pipes. Preferably two spacer pipes are used on each side of fenders 20 and 22. Preferably metal rods 28 and 30, respectively, support the fenders and connect to central connector 14. Rods 28 and 30 have respective eyebolts 32 and 34 that connect to respective guide lines 16 and 18.

Guide frame 13 also includes crossover line 36 that extends between elongate slide members 38 and 40.

Guide frame 13 is movable along elongate slide members 38 and 40 that are preferably guide lines or cables secured between respective pairs of pilings 42, 44, and 46, 48, respectively. Other suitable fixed members of the dock could be used besides the pilings although pilings are typically conveniently available. Guide frame 13 is thus slidable supported on elongate slide member 38 and 40 with slidable connectors 50, 52 and 54, 56, respectively. Therefore guide frame 13 is free to move inwardly and outwardly from boat docking apparatus **10*a* in a direction substantially parallel to axis 58 and elongate slide members 38 and 40. The equipment and construction making up guide frame 13 for use along slide member 40 will be described in some detail and it will be understood that the corresponding equipment and construction along slide member 38 is substantially identical unless otherwise noted. Elongate slide member 40 is preferably a nylon line and may be secured between pilings 46 and 48 in a suitable manner but could be any elongate structure that allows operation in the manner described herein such as rails, metal cables, and the like. A height adjustment device 60, that may include several vertically spaced notches (not shown), may be used on one or both pilings for conveniently adjusting the vertical position of boat dock 10A for the average tide range or the like. A turn buckle 62 or other line tightening device may be used to tighten elongate slide member 40**.

Figure 4:
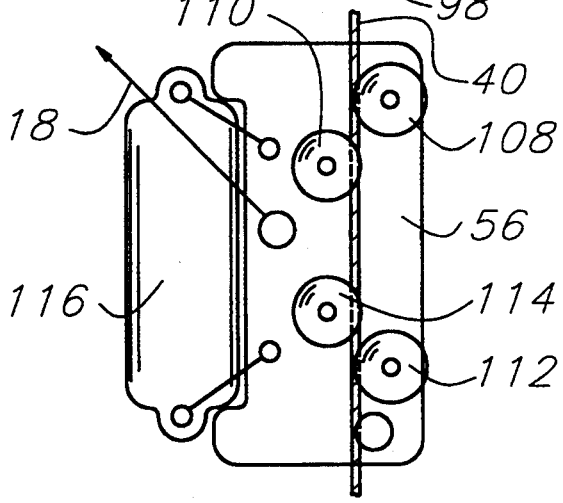
FIG. 4 is a top plan view of a two-position center bracket for convening the boat docking system of FIG. 1 between the bow-to-dock and stern-to-dock receiving configurations in accord with the present invention.

Referring to FIG. 4, there is disclosed a preferred sliding connector 56 that can also be referred to as a main traveler. To maintain its orientation as it moves along elongate slide member 40, four sheaves 108, 110, 112, and 114 are preferably used. Sliding connector 56 supports fender 116 that may softly engage the boat to prevent scratching the surface.

Stop pipe 64 is preferably a heavy gauge PVC pipe. Stop pipe 64 prevents further motion of guide frame 13 inwardly and more specifically stop motion of sliding connector 54 along elongate slide member 40. Sliding connector 54 preferably includes a single sheave wheel mounted in a suitable frame. Sliding connector 54 could also have multiple sheave wheels mounted in a frame as does sliding connector 56 that is shown in FIG. 4. Conceivably, to reduce costs to a minimum, the sliding connectors could even be suitable diameter PVC pipes, or galvanized pipes, threaded onto elongate slide member 38 and preferably having an eyelet for a connector to the appropriate line for sliding along elongate slide member 38.

Spring-loaded push pipe assembly 65 extends between sliding connector 54 and sliding connection 56. Although three springs 66, 68, 70 are used with two push pipes 72, 74 in spring-loaded push pipe assembly 65, it will be understood that the number of these individual components may be varied to provide the ideal amount of compression for the length and weight of the boat. The number and length of the individual components of spring-loaded push pipe assembly 65 is also coordinated with the length of guide line 18.

Figure 6:
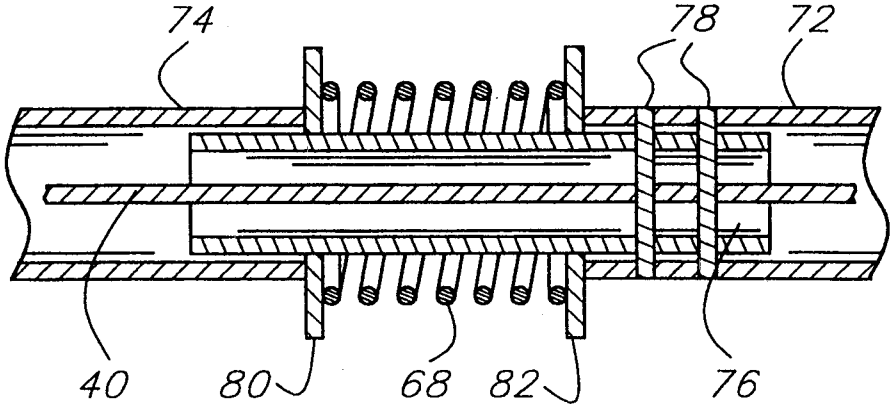
FIG. 6 is a diagrammatic view, in section, of a push pipe with compression spring in accord with the present invention.
Figure 7:
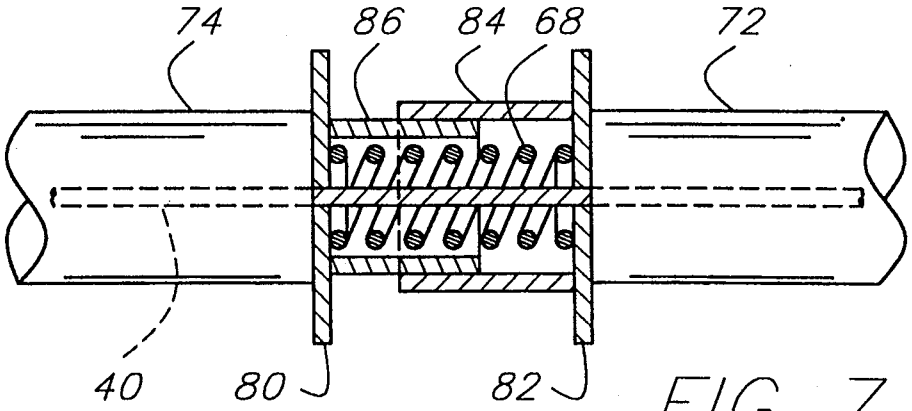
FIG. 7 is a diagrammatic view, in section, of a compression spring connection in accord with the present invention.

FIG. 6 and FIG. 7 schematically illustrate two methods of interconnecting spring-loaded push pipe assembly 65. It will be understood that numerous methods may be used to interconnect spring-loaded push pipe assembly 65 so that it operates as required by the present invention. In FIG. 6, push pipe 72 is affixed to spring guide 76 with rivets or bolts 78. Spring guide 76 is preferably a smaller O.D. PVC pipe and functions to prevent spring 68 from buckling. Washers 80 and 82 may be plastic, nylon, metal, and the like, and are sized to provide a engagement surface for spring 68. Thus, with compression force acting on push pipe 74, spring guide 78 moves into push pipe 74 as spring 68 compresses.

Various types of springs may be used and because there is no need for precise specification of size or tension, it is possible to use less expensive springs. The length of guide line 18 is preferably chosen to hold the components of spring-loaded push pipe assembly 65 in sufficient compression so that the components are held together and so their overall length matches to that of the boat or range of boats that may be docked.

In FIG. 7, another interconnection is schematically shown between push pipes 72 and 74. It will be understood that those skilled in the art may provide other spring-push pipe interconnections or use other components to provide the function of this feature of the invention as generally proscribed by availability and convenience. For instance, it may be desired simply to use washers and springs with no spring guides. This may be especially appropriate where the springs obtained are sufficiently sturdy that it is not expected they will buckle. As well, the tension in elongate slide member 40 may be sufficient in itself to act as a spring guide for a spring that might otherwise buckle. In FIG. 7, spring 68 is encased in telescoping guide pipes 84 and 86 that telescope inwardly as a compression force is placed on push pipe 74. As with the assembly shown in FIG. 6, the components are preferably kept in some compression by guide line 18 acting to limit the spacing between sliding connector 54 and 56.

Figure 2:
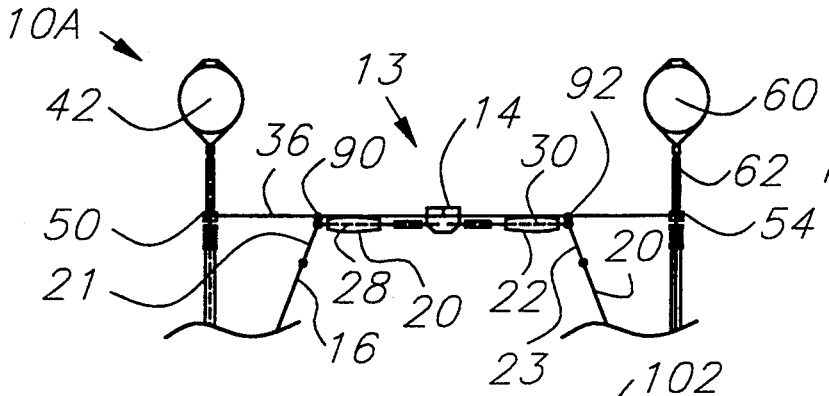
FIG. 2 is a diagrammatic view of the boat docking system of FIG. 1, configured for receiving the aft end of the boat.
Figure 3:
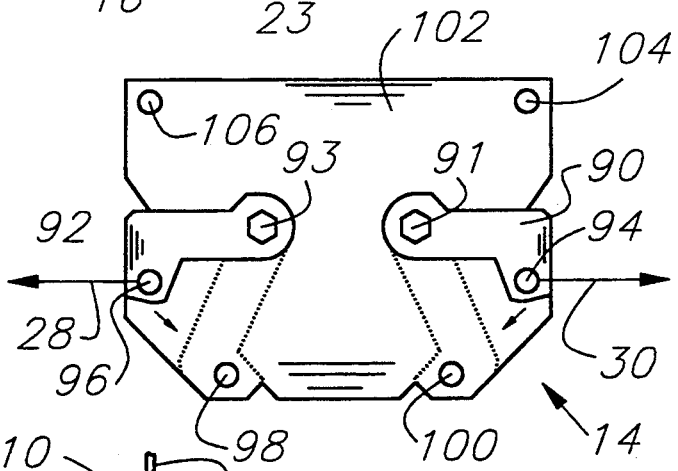
FIG. 3 is a top plan view of a main traveler used in the boat docking system in accord with the present invention.

Referring now to FIG. 3, there is disclosed a two position central connector 14 in the stem-to-dock position as indicated in FIG. 2 at the apex of lines 16 and 18. Arms 90 and 92, that are pivotal at bolts 91 and 93 respectively, move from a stem-to-dock position to a bow-to-dock position as indicated by dashed lines. Holes 94 and 96 of arms 90 and 92 may be matched with corresponding holes, such as holes 98 and 100 in central connector body 102. Thus, a latch or eyelet from rod 28 may extend through hole 96 in arm 90, and hole 98 in body 102 to thereby lock the arm in the desired position. Holes 104 and 106 are connected to cross-over line 36.

FIG. 2 discloses boat docking apparatus 10A in the stem-to-dock position. In this position, rods 28 and 30 are secured to eyelets or rings 90 and 92 to provide a wide flat back for guide frame 13 for receiving the stem of the boat while still leaving a V-shaped or open mouth portion of the guide frame formed by guide lines 16 and 20 to receive the boat. Adjusting lines 21 and 23 may be used to adjust the tautness of guide frame 13. For altering guide frame 13 to receive the boat, center connector 14 is moved to the stem-to-dock position as discussed hereinbefore. Thus, boat docking system 10A of the present invention can be readily and quickly converted to accommodate the preferred docking orientation of the boat.

Figure 5:
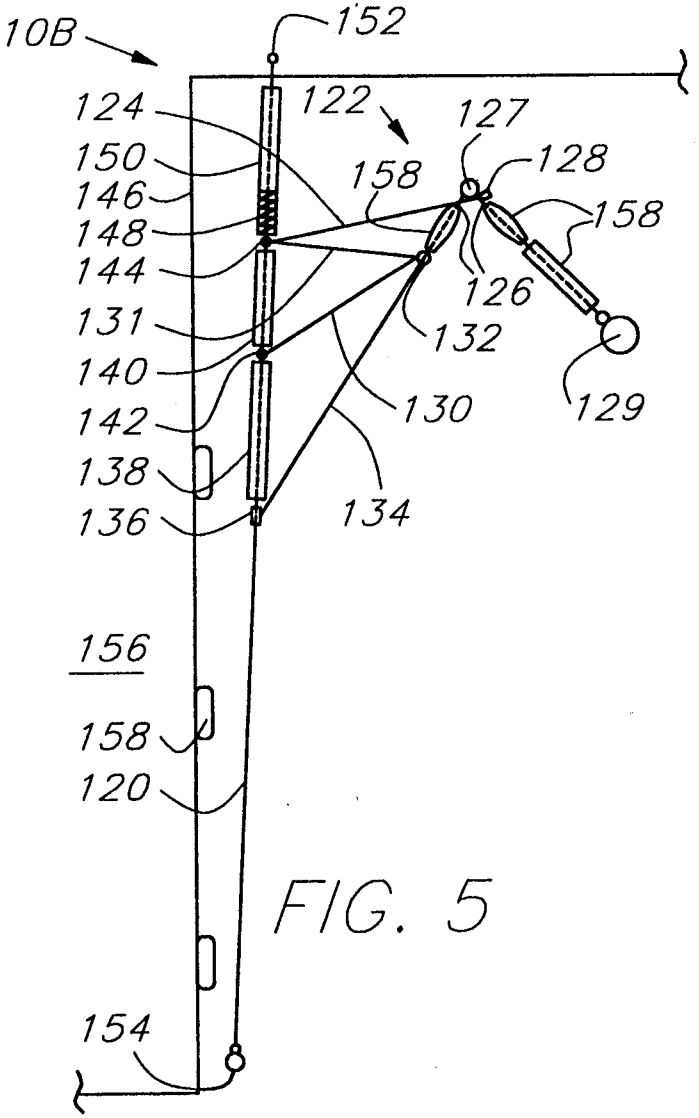
FIG. 5 is a diagrammatic view of a boat docking system in accord with the present invention for use with a floating dock.

FIG. 5 discloses another embodiment of the present invention boat docking apparatus 10B for floating boat docks. Substantially the same components are used except that only one elongate slide member 120 is used rather than two elongate slide members as with the non-floating docks. As with system 10A, elongate slide member 120 is preferably a covered stainless steel cable i.e. a one-quarter inch life line. Guide frame 122 is buttressed to compensate for having only one elongate slide member.

For this purpose, preferably quarter-inch or larger steel support rods are used with each support rod preferably having an eyebolt at any free end. Thus, fore rod 124 connects to V-shaped apex rod 126. Apex rod 126 may include two rods welded together and having a support member 128 welded therebetween. Apex rod 126 is shaped to conform to the contour of the bow of the boat. Float balls 127 and 129 may be used to support apex rod 126. Alternatively and/or in conjunction, floating fenders may be used for floating support as discussed herein later.

Aft rod 130 and middle rod 131 connect to eyebolt connector 132 that also connects to one end of apex rod 126. Guide line 134 connects between eyebolt connector 132 and sliding connector 136. Push pipes 138 and 140 are mounted between sliding connectors 136, 142 and 144 and maintain the desired distance therebetween.

Thus, guide frame 122 of boat docking system 10B is movable along elongate guide member in the same manner as guide frame 13 of boat docking system 10A. Spring-loaded stop pipe assembly 146 is provided to gently stop movement of the boat. Although only one spring 148 and stop pipe 150 are shown, the number of springs and pipes can be adjusted as desired as was the case with spring-loaded stop pipe assembly 65 discussed hereinbefore. The various interconnections and components thereof already described are also suitable for spring-loaded stop pipe assembly 146.

Docking system 10B is thus supported between two supports 152, 154 which are preferably secured to and may typically float with floating boat dock 156. Various fenders 158 may be used as desired where contact with the boat may be expected. Preferably elongate slide member 120 is angled slightly outwardly from floating dock 156 with the stopping position being somewhat further. Because floating dock 156 moves with the tides vertical adjustments for docking system 10B are not generally required. Elongate slide member is preferably positioned somewhat above the water surface but could be beneath the water and the various rods bent accordingly.

In operation docking systems 10A and 10B work substantially the same. The captain need only be accurate enough in directing the boat to come within the elongate slide members or, with system 10B, within the open-mouth or V-shaped portion of apex rod 128 or any member that extends therefrom. The boat will then be guided inwardly toward the dock within the respective guide frame and gently but firmly stopped by the respective spring-loaded stop pipe assembly at the desired stopping point. At that time, the boat can be conveniently tied to the dock.

It is preferable to pull the guide frame outwardly along the elongate slide member when the boat leaves the dock. This can be conveniently accomplished in a number of ways. The inventor preferably uses a wooden stick (not shown) with a weight on one end and a cord on the other end that also connects to the bow of the boat for bow-to-dock docking. The stick floats in the upright position with a portion extending out of the water. After docking the stick is dropped on the opposite side of the apex or end of the guide frame with respect to the boat. Upon backing the boat out, the stick pulls the guide frame outwardly to the correct position and when the guide frame is set and moves no further, the stick slides over the guide frame apex and can be conveniently pulled into the boat. Other setting systems could also be used. For instance, a velcro connector (not shown) could be attached to the guide frame that would pull the guide frame outwardly and then detach when the guide frame stopped. A weighted pulley system (not shown) that has a pulley on the outermost piling with a line connected at one end to the frame or sliding connector and with the other end weighted so that the guide frame moves outwardly automatically.

The docking system of the present invention allows the Captain to generally point the boat towards the rather wide target formed by the V-shaped receiving line configuration of the various embodiments. The V-shaped receiving configuration guides the boat to the central connector or apex and moves in a generally straight line towards the dock until being safely stopped by the spring-loaded push pipe assembly.

The Captain may leave the boat motor, if there is one, on low speed while this occurs and then moor the boat prior to shutting off the engine. Thus, the present invention provides substantially effortless, inexpensive, reliable and safe means for performing the difficult maneuver of docking the boat.

The foregoing description of the invention has been directed in primary part to a particular, preferred embodiment in accordance with the requirements of the patent statutes and for purposes of illustration. It will be apparent, however, to those skilled in the art that many modifications and changes in the specifically described boat docking apparatus and method may be made without departing from the scope and spirit of the invention. Therefore, the invention is not restricted to the preferred embodiments illustrated but covers all modifications which may fall within the spirit of the invention or the following claims.

What is claimed:

1. A docking apparatus for docking a boat, comprising:

a guide frame for receiving said boat, said guide frame being open at one end and having an open mouth wedge-shaped portion operable for receiving and directing said boat towards an end region of said guide frame;

at least one elongate slide member adjacent said guide frame for supporting said guide frame, said guide frame being movable in a direction substantially parallel to said at least one elongate slide member;

first and second sliding connectors for securing said guide frame with respect to said at least one elongate slide member, said first and second sliding connectors being movable along a portion of said at least one elongate slide member;

a push pipe slidingly carried by said at least one elongate slide member between said first and second sliding connectors, said push pipe being movable along said at least one elongate slide member with said first and second sliding connectors;

a compression member disposed on said at least one elongate slide member; and a stop member substantially immovable with respect to said at least one elongate slide member, said stop member being operable to compress said compression member against the momentum of said boat as said guide frame moves in a direction substantially parallel to said first elongate slide member for compressibly stopping movement of said boat.

2. The docking apparatus of claim 1, further comprising:

a second elongate slide member substantially parallel to said at least one elongate slide member, said guide frame being supported between said first and second elongate slide members.

3. The docking system apparatus of claim 2, wherein said guide frame further comprises:

a center bracket disposed in said end region of said guide frame, and a pair of guide members secured to said center bracket and forming said wedge shaped portion.

4. The docking apparatus of claim 3, further comprising:

a crossover member disposed transverse to said first and second elongate sliding members, and said center bracket being mounted approximately at a center region of said crossover member, said center bracket having a pivot for pivoting with at least a part of each of said pair of guide members.

5. The docking apparatus of claim 4, further comprising:

fasteners disposed on each side of said center bracket on said cross-over member, said fasteners cooperating with said pivot of said center bracket and at least a part of each of said pair of guide members for altering said docking system between a first position for bow-to-dock docking and a second position for stern-to-dock docking.

6. The docking apparatus of claim 5, wherein:

said at least a part of each of said pair of guide members are substantially V-shaped in said end region in said first position for bow-to-dock docking.

7. The docking apparatus of claim 5, wherein:

said at least a part of each of said pair of guide members are substantially parallel to said crossover member in said second position for stern-to-dock docking.

8. The docking apparatus of claim 1, wherein said first sliding connector further comprises:

a main traveler having a plurality of wheels mounted thereon for rolling engagement with said at least one elongate slide member.

9. The docking apparatus of claim 8, further comprising:

a frame member, a first wheel mounted to said frame member on one side of said elongate slide member, and a second wheel mounted to said frame member on the opposite side of said elongate slide member.

10. The docking apparatus of claim 8, further comprising:

a pliable fender secured to said main traveler for engagement with said boat.

11. The docking apparatus of claim 1, further comprising:

a ball float for supporting said guide frame in said end region.

12. The docking apparatus of claim 1, wherein:

said wedge-shaped portion of said guide frame is formed with flexible cables.

13. The docking apparatus of claim 1, wherein:

said portion of said guide frame is formed of substantially rigid metallic rods.

14. The docking apparatus of claim 1, further comprising:

a second elongate slide member substantially parallel to said at least one elongate slide member, said guide frame being supported between said first and second elongate slide members, and four rigid securing members affixed into position by at least one pile, two of said four rigid securing members supporting said at least one elongate slide member and two of said four rigid securing members supporting said second elongate slide member.

15. The docking apparatus of claim 1, wherein: said guide frame is slidably secured to said at least one elongate slide member on side thereof, said guide frame is not connected to another of said at least one elongate slide members on an opposite side thereof.

16. A docking apparatus for docking a boat, comprising:

a guide frame for receiving said boat, said guide frame being open at one end and having an open mouth wedge-shaped portion operable for receiving and directing said boat towards an end region of said guide frame;

at least one elongate slide member adjacent said guide frame for supporting said guide frame, said guide frame being movable in a direction substantially parallel to said at least one elongate slide member;

guide frame sliding connectors for slidingly securing said guide frame with respect to said at least one elongate slide member, said sliding connectors being movable along said at least one elongate slide member;

a push pipe slidingly carried by said at least one elongate slide member between said first and second sliding connectors, said push pipe being substantially axially aligned with said at least one elongate slide member;

a compression member disposed on said at least one elongate slide member, said compression member being substantially axially aligned with said at least one slide member; and a stop member substantially immovable with respect to said at least one elongate slide member, said stop member being substantially aligned with said at least one slide member, said stop member being operable to compress said compression member as said guide frame moves in a direction substantially parallel to said first elongate slide member for compressibly stopping movement of said boat.

17. The docking apparatus of claim 16, wherein:

said guide frame being adjustable from a V-shape to a flat portion in said end region to selectively conform to a bow or a stem of said boat.

18. A method for docking a boat, comprising the steps of:

providing an open mouth frame for guiding said boat toward a desired target region;

steering said boat into said open mouth frame;

moving said open mouth frame in a target direction toward said desired target region using the momentum of said boat;

slidably supporting said open mouth frame with respect to an elongate member, said elongate member being substantially parallel to said target direction;

disposing an elongate compression member substantially parallel to said target direction;

compressing said elongate compression member with said momentum of said boat to thereby de-accelerate said boat.

19. The method of claim 18, further comprising:

selectively altering a boat engagement portion for receiving either a bow of said boat or a stem of said boat.

20. The method of claim 18, further comprising:

securing said elongate member to a floating dock.

* * * * *